US012326083B1

(12) United States Patent
Zhang

(10) Patent No.: US 12,326,083 B1
(45) Date of Patent: Jun. 10, 2025

(54) SECONDARY STEERING PAD RETENTION MECHANISM

(71) Applicant: Halliburton Energy Services, Inc., Houston, TX (US)

(72) Inventor: Lizheng Zhang, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/581,188

(22) Filed: Feb. 19, 2024

(51) Int. Cl.
*E21B 7/06* (2006.01)

(52) U.S. Cl.
CPC ..... *E21B 7/06* (2013.01)

(58) Field of Classification Search
CPC ..... E21B 7/06; E21B 7/04
See application file for complete search history.

(56) References Cited

U.S. PATENT DOCUMENTS 4,471,843 A * 9/1984 Jones, Jr. ..... E21B 7/06 175/73
5,467,834 A * 11/1995 Hughes ..... E21B 7/062 175/325.1
5,655,609 A * 8/1997 Brown ..... E21B 17/1021 175/325.1
9,714,554 B1 7/2017 Cook et al.
11,174,682 B2 11/2021 Doud et al.
11,280,135 B2 3/2022 Doud et al.
2004/0134687 A1 7/2004 Radford et al.
2020/0332597 A1* 10/2020 Doud ..... E21B 7/067
2020/0332599 A1 10/2020 Doud et al.
2021/0087885 A1* 3/2021 Chambers ..... E21B 7/061

FOREIGN PATENT DOCUMENTS

WO 2012162744 12/2012

OTHER PUBLICATIONS

"PCT Application No. PCT/US2025/010085 International Search Report and Written Opinion", Apr. 17, 2025, 10 pages.

* cited by examiner

*Primary Examiner* — Brad Harcourt
(74) *Attorney, Agent, or Firm* — DeLizio, Peacock, Lewin & Guerra LLP

(57) ABSTRACT

A rotary steerable system is disclosed. The rotary steerable system includes a tool collar having cavities and through holes extending there through to interconnect the cavities. The rotary steerable system also includes pad pushers each positionable within the plurality of cavities to be coupled to the tool collar, each pad pusher coupled to a respective pad retention housing on the uphole end and the downhole end of the tool collar. A secondary retention mechanism is slidably attached to the tool collar and coupled with a respective pad retention housing.

20 Claims, 6 Drawing Sheets

SECONDARY STEERING PAD RETENTION MECHANISM

TECHNICAL FIELD

The present disclosure generally relates to downhole tools, and more specifically to a secondary mechanism for retaining pad pushers to a tool body.

BACKGROUND

A rotary steerable system (RSS) is a directional drilling tool used in downhole environments to steer a drill bit in a given direction in response to commands transmitted from surface equipment. When drilling downhole, the RSS may be subjected to various negative environmental conditions based on formation conditions or texture at a level below ground level where drilling is taking place. In such instances, increased wear and tear on the downhole rotary steerable tool may be experienced as a result of various components of the downhole rotary steerable tool becoming loose or coming apart altogether. This, in turn, may negatively impact the cost and efficiency of drilling production, such as in instances in which the RSS may need to be brought back to the surface for repair and/or maintenance. For example, steering pads mounted to a collar of the RSS may be susceptible to coming loose under extreme downhole conditions (e.g., extreme vibration caused by the drill bit engaging with various types of formation rocks).

BRIEF DESCRIPTION OF THE DRAWINGS

Illustrative embodiments of the present disclosure are described in detail below with reference to the attached drawing figures, which are incorporated by reference herein, and wherein.

The illustrated figures are only example and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As stated above, the rotary steerable system (RSS) may experience increased wear and tear from typical use in downhole environmental conditions and/or significant high-frequency torsional oscillation (HTFO), resulting in components of the RSS becoming loose or coming apart altogether. To prevent this, it is preferable that the steering pad housings are mounted robustly so as to be less susceptible to loosening or falling apart. Generally, the RSS steering heads include pad pushers, which are mounted robustly to a tool collar of the drill bit. Pad pushers are coupled to primary pad retention housings, which are then mounted to the collar using fastening bolts.

To provide an even more robust mounting of the steering pad housings such that the lateral pads are maintained even if the fastening bolts are broken or come apart from the housing, the present disclosure includes secondary pad retention configuration, which can be embodied as one or more generally ring-shaped objects (referred to hereafter as "pad rings") that are slidable onto the collar on the pad assembly to further secure the respective lateral pads. The pad rings themselves may be attached to the collar using some securing mechanism, such as shear pins (or threads) that are able to withstand operational and environmental conditions in the downhole setting.

Advantageously, embodiments of the present disclosure provide a robust configuration of steering heads which improve downhole reliability, resulting in fewer drilling hours lost for tool repairs and reduced replacement and maintenance costs. Providing secondary retention of the lateral pads, the pad rings are less likely to fall apart, therefore securing the primary retention housing and thus more robustly securing the lateral pads to the collar.

Figure 1:
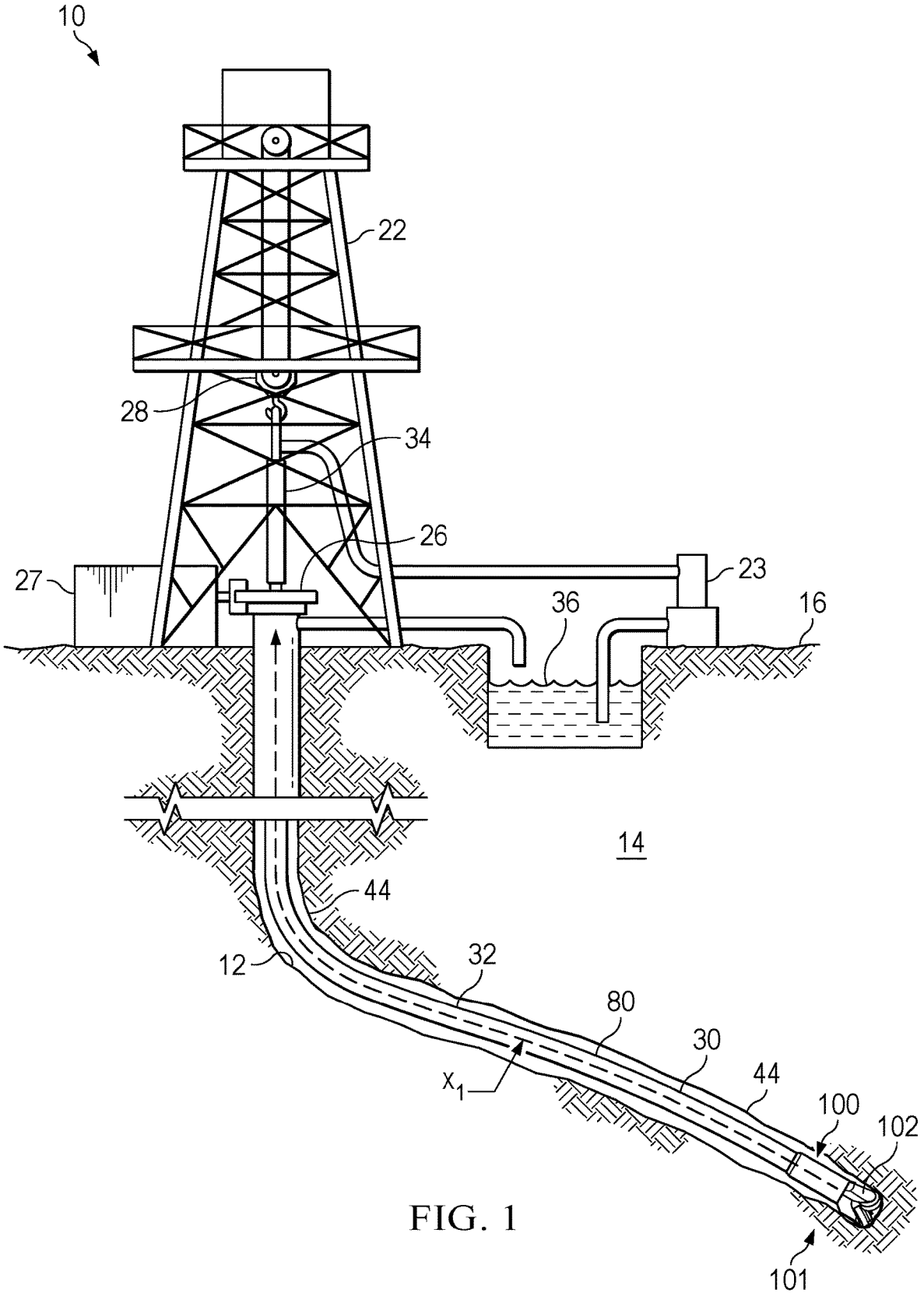
FIG. 1 illustrates a partial cross-sectional view of an onshore well system including a downhole tool illustrated as part of a tubing string, according to some embodiments of the present disclosure.

FIG. 1 shows a representative elevation view in partial cross-section of an onshore well system 10 which can include a drilling rig (or derrick) 22 at the surface 16 used to extend a tubing string 30 into and through portions of a subterranean earthen formation 14. The tubing string 30 can carry a drill bit 102 at its end which can be rotated to drill through the formation 14. A bottom hole assembly (BHA) 101 interconnected in the tubing string 30 proximate the drill bit 102 can include components and assemblies (not expressly illustrated in FIG. 1), such as, but not limited to, logging while drilling (LWD) equipment, measure while drilling (MWD) equipment, a bent sub or housing, a mud motor, a near bit reamer, stabilizers, steering assemblies, and other downhole instruments. The BHA 101 can also include a downhole system 100 that can provide steering to the drill bit 102, mud-pulse telemetry to support MWD/LWD activities, stabilizer actuation through fluid flow control, and a rotary steerable tool used for steering the wellbore 12 drilling of the drill bit 102. Steering of the drill bit 102 can be used to facilitate deviations 44 as shown in FIGS. 1 and 2, and/or steering can be used to maintain a section in a wellbore 12 without deviations, since steering control can also be needed to prevent deviations in the wellbore 12.

At the surface location 16, the drilling rig 22 can be provided to facilitate drilling the wellbore 12. The drilling rig 22 can include a turntable 26 that rotates the tubing string 30 and the drill bit 102 together about the longitudinal axis XL. The turntable 26 can be selectively driven by an engine 27, and selectively locked to prohibit rotation of the tubing string 30. A hoisting device 28 and swivel 34 can be used to manipulate the tubing string 30 into and out of the wellbore 12. To rotate the drill bit 102 with the tubing string 30, the turntable 26 can rotate the tubing string 30, and mud can be circulated downhole by mud pump 23. The mud may be a calcium chloride brine mud, for example, which can be pumped through the tubing string 30 and passed through the downhole system 100. In some embodiments, the downhole system 100 can include a steering head, and a rotary valve that selectively applies pressure to at least one output flow path to hydraulically actuate the steering head. Additionally, the mud, if used above the rotary steerable tool and drill bit, can be pumped through a mud motor (not expressly illustrated in FIG. 1) in the BHA 101 to turn the rotary steerable tool and the drill bit 102 without having to rotate the tubing string 30 via the turntable 26.

Figure 2:
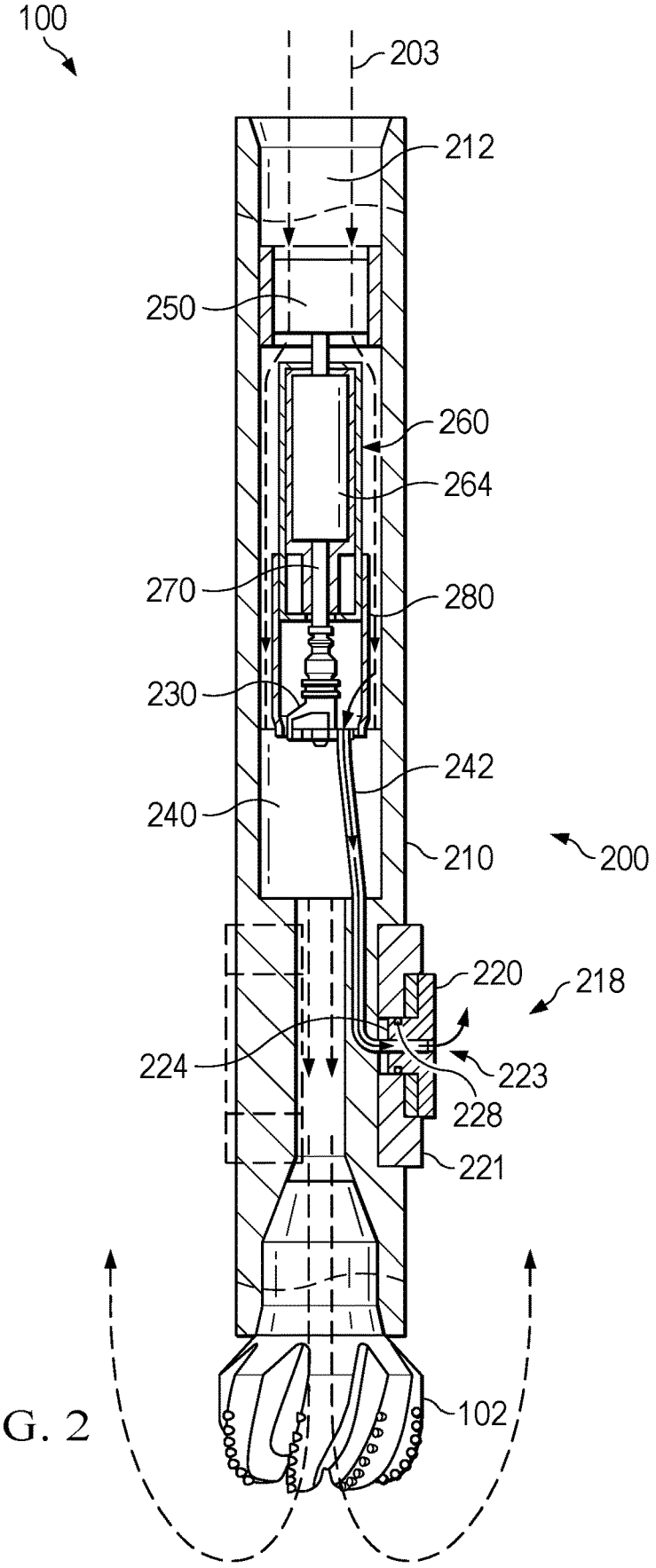
FIG. 2 illustrates a sectional view of the example downhole tool of FIG. 1, including a steering head, according to some embodiments of the present disclosure.
Figure 3:
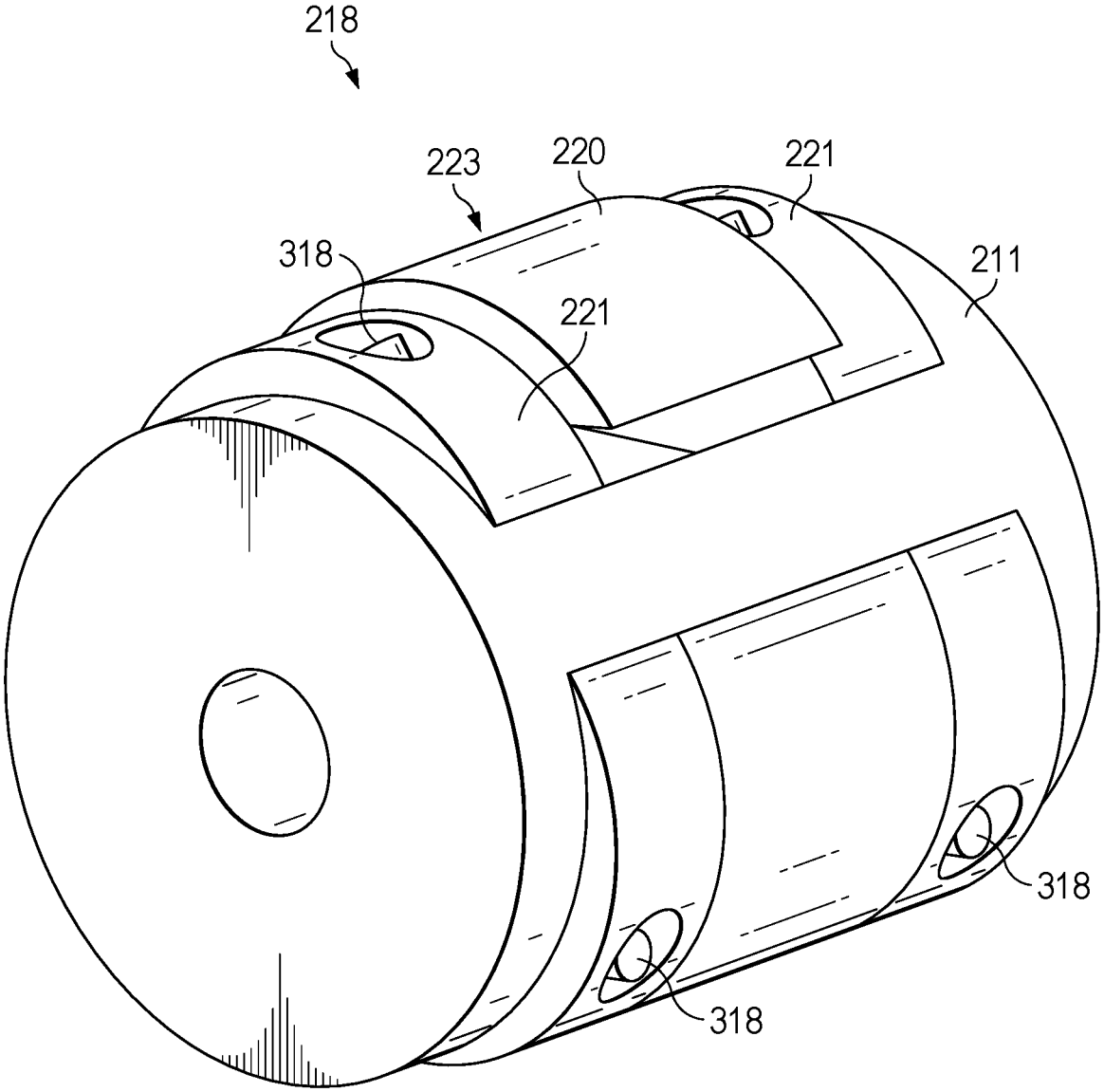
FIG. 3 illustrates a perspective side view of the example downhole tool of FIG. 2, according to some embodiments of the present disclosure.

FIG. 2 illustrates a sectional view of the example downhole tool of FIG. 1, having a drill string steering system including a steering head, according to some embodiments of the present disclosure. According to various embodiments of the present inventions, the drill string system 200 includes a steering head 218 including one or more pad pushers 223. Although FIG. 2 depicts one pad pusher 223, the disclosed embodiments are not limited to this configuration. In some embodiments, the steering head includes two pad pushers 223, and in other embodiments, three or more pad pushers 223. Each of the pad pushers 223 includes a steering pad 220 and a piston 224. As depicted, the steering pad 220 and the piston 224 may be coupled to each other using any suitable coupling mechanism. In some embodiments, the steering pad 220 and the piston 224 may be integrally formed as a single continuous body or material. In yet other embodiments, however, the piston 224 and the steering pad 220 may be separate components, with the piston 224 being actuatable to contact and move the steering pad 220 to push against the earth 102 to provide the desired drilling vector. As depicted in FIGS. 2 and 3, hydraulic fluid 203, e.g. mudflow flows into the drill string steering system 200 from the uphole end and passes through the central bore 212 to a rotary valve 230 and a flow manifold 240 to control mud flow to the piston 224 which then operates to extend the steering pad 220.

As depicted, the steering head 218 is configured with a channel or bore 226 in which the piston 224 reciprocates upon being hydraulically or otherwise actuated. In some embodiments, the piston channel or bore 226 may be a linear channel or bore. In yet other embodiments, the piston channel or bore 226 in which the piston 224 reciprocates may be a curved channel or bore.

As the mud flows through the central bore 212, the mud can flow through a turbine 250 and past an electric generator, steering controller and electric motor assembly 260 used to control the angular position of the rotary valve 230. In the depicted example, mudflow 203 can pass through a filter screen 280 prior to passing through the rotary valve 230 and the flow manifold 240. The filter screen 280 can include apertures or openings sized to allow the flow of mud while preventing debris from passing through the flow manifold 240 and to components downstream of the flow manifold 240 to prevent obstruction and damage to the downstream components. The filter screen 280 can be formed from a metallic or ceramic perforated cylinder or mesh or any other suitable filter material.

In the depicted example, the rotary valve 230 and the flow manifold 240 regulate or control the flow of the mud there through to control the extension of the steering pads 220. In some embodiments, the rotation of the rotary valve 230 abutted against the flow manifold 240 controls the flow of mud through the flow manifold 240. The rotary valve 230 is rotated by a motor 264 within an electric generator, steering controller and electric motor assembly 260.

In the depicted example, as mud flow is permitted by the rotary valve 230, the mud flow can continue in a piston flow channel 242 of the flow manifold 240. In some embodiments, a piston flow channel 242 can pass through the flow manifold 240 and the tool body 210 to provide mud flow to the piston channel or bore 226. In the depicted example, the tool body 210 includes one piston bore 226. However, as shall be illustrated and described in the various embodiments of the present disclosure, the tool body 210 can include one or more piston bores 226 formed in the tool body 210. In some embodiments, the piston bores 226 are disposed within pad retention housings 221 formed within the tool body 210. In the depicted example, mud flow from the piston flow channel 242 is received by the piston bore 226 and the piston seals 228 to actuate and extend the piston 226. As illustrated, the steering pad 220 is integrally formed with the piston 224. However, as previously discussed, the steering pad 220 and the piston 224 may be separately formed and otherwise coupled. As described herein, the combination of the steering pad 220 and the piston 224, whether being formed as separate parts that are coupled together, or being formed as a part of a single, continuous body, shall be referred to as a pad pusher 223. The pad pusher 223 may be actuated by the mud flow provided through the piston flow channel 242, for the piston 224 to extend the steering pad 220 radially outward against the wall of the wellbore 12.

Pressure against the piston 224 can be relieved by a relief flow channel 222 formed through the pad pusher 223. Mud flow can pass through the relief channel 222 to allow for maintaining or reducing pressure upon the piston 224 to facilitate the retraction of the piston 224 when the rotary valve 230 has closed mud flow to that piston. In some embodiments, the mud flow can bypass the filter screen 280 and the flow past the manifold 240 to continue through the central bore 212 as a bypass flow 214. The bypass flow 214 can continue through the downhole end 204 of the drill string steering system 200 and can be directed to the bit nozzles 113 of the drill bit 102 to be circulated into an annulus of the wellbore 12.

In the depicted example, the motor 264 is an electrical motor that can be controlled to rotate the rotary valve 230 as desired to provide a desired drilling vector. In the depicted example, the motor 264 is contained within a motor housing 262 and rotates the rotary valve 230 via a motor shaft 270. In some embodiments, the motor 264 maintains the rotary valve 230 in a geostationary position as needed.

In the depicted example, components of the electric generator, steering controller and electric motor assembly 260 can be disposed, surrounded, bathed, lubricated, or otherwise exposed to a lubricant 265 within the motor housing 262 while many of the controller electronic components are protected in a protective pressure barrier cavity (not shown). In some embodiments the lubricant 265 is oil that is isolated from the mud within the wellbore. In the depicted example, the pressure of the lubricant 265 can be balanced with the downhole pressure of the mud. In some embodiments, a compensation piston 266 can pressurize the lubricant 265 to the same pressure as the surround mud without allowing fluid communication or mixing of the mud and the lubricant 265. In some embodiments, a biasing spring 268 can act upon the compensation piston 266 to further provide additional pressure to the lubricant 265 within the motor housing 262 relative to the pressure of the mud. The biasing spring 268 can impart around 25 psi of additional pressure, over the mud pressure, to the lubricant 265 within the motor housing 262. In some embodiments, electrical energy for the motor 264 is generated by mud flow passing through the turbine 250. In some embodiments, the turbine 250 can rotate about a turbine shaft 252 and power an electric generator.

In the embodiments, the steering pad 220 and the piston 224 are integrally formed. However, as previously discussed, the steering pad 220 and the piston 224 may be separately formed and otherwise coupled. The term "integrally formed" can refer to a configuration in which the steering pad 220 and the piston 224 are formed as a single, continuous body or material. Thus, the steering pad 220 and the piston 224 can move together along the same path. In some embodiments the path is a curved path which is defined by a curved piston liner defining the piston bore 226. In other embodiments, the piston channel or bore 226 may be a linear channel or bore. Thus, as depicted in FIG. 2, the piston 224 is actuated by the hydraulic fluid 203, e.g., pressurized mud flow, thereby causing the piston 224 and the steering pad 220 which move as an integral part, to move along the path defined by the piston liner. In some embodiments, the steering pad 220 can have a semi-circular cross-sectional profile.

In the example illustrated in FIG. 2, the pad pusher 223 is actuated by receiving mudflow 203 in the piston bore 226 from the piston flow channel 242. A piston seal 228 prevents the migration of fluid out of the piston bore 226. As the pad pusher 223 extends, the steering pad 220 can pivot relative to the tool collar 211.

Figure 4:
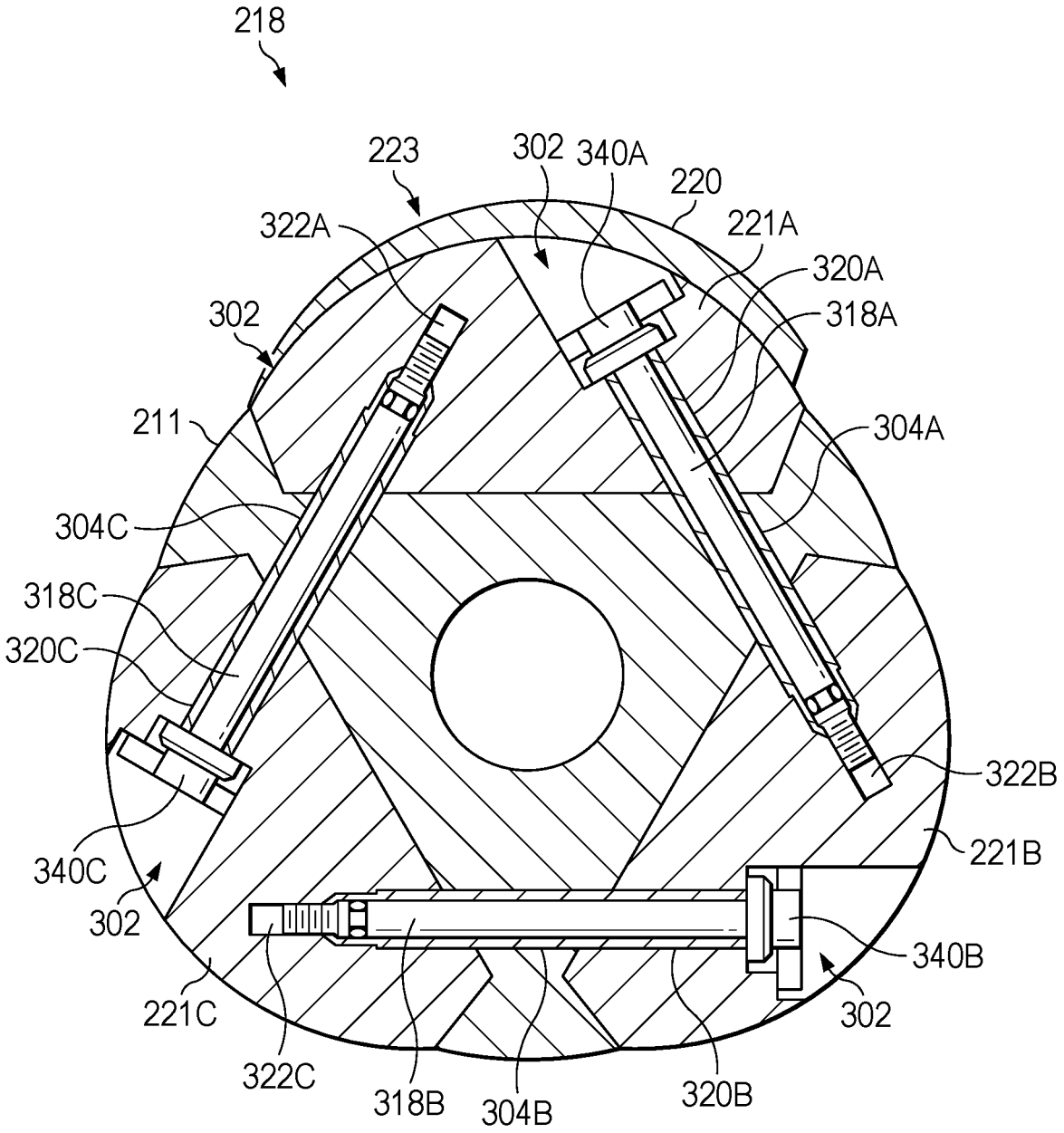
FIG. 4 illustrates an example steering head mounted to a collar of the downhole tool, according to some embodiments of the present disclosure.

FIG. 3 illustrates an example steering head 218 mounted to a collar 211 of the downhole system 100, according to some embodiments. In the depicted embodiments, the steering head 218 includes a plurality of pad pushers 223 mounted onto or about the collar 211. Although two pad pushers are depicted in FIG. 4, the steering head 218 is not limited to this configuration and may include only one pad pusher 223, or more than two pad pushers 223. In some embodiments, the steering head 218 includes one or more pad retention housings 221. Although two pad retention housings 221 are depicted, the steering head 218 is not limited to this configuration and may include only one pad retention housing 221 or more than two pad retention housings 221. Illustratively, each of the pad retention housings 221 may be mounted onto the collar 211 using fasteners 318. The fasteners 318 are positioned through each of the pad retention housings 221 to couple the pad retention housings 221 to each other around and/or through the collar 211. As also illustrated, each of the pad pushers 223 can be mounted to the collar 211 via a respective pad retention housing 211. That is, since each of the pad pushers 223 are directly, pivotally coupled to a respective housing 221, the pad pushers 223 are thus indirectly coupled to the collar 211 through the pad retention housings 221.

Referring now to FIG. 4, a cross-sectional view of the example steering head 218 of FIG. 3 depicts a coupling of a plurality of pad retention housings 221 around the collar 211, according to some embodiments. In some embodiments, as illustrated in FIG. 4, the rotary steerable system 100 includes first, second, and third pad retention housings 221A, 221B, and 221C coupled to each other as a unit about collar 211. In the example depicted in FIG. 4, each of the pad retention housings, e.g., housing 221A, includes a pad pusher 223 pivotally coupled thereto. In some embodiments, each of the retention housings 221A, 221B, and 221C includes a respective pad pusher 223 pivotally coupled thereto. As depicted, each of the pad pushers 223, is positionable within a respective cavity of the tool collar 211. Each pad pusher 223 can be movable between a retracted position and an extended position (see e.g., steering pad 220) relative to the tool collar 211. In the extended position, the steering pad 220 of each steering pad pusher 223 pivots radially outward with respect to the tool collar 211 to contact the formation so as to direct a steering direction of the downhole system 100. In the illustrated embodiments, the pad pushers 223 are fastened to each other as a unit around the collar 211. To this effect, the collar 211 includes a plurality of cavities 302 into which each of the pad pushers 223 are positioned to be coupled to the tool collar 211. Further, the collar 211 includes a plurality of through holes 304 (304A, 304B, and 304C) which extend transverse relative to a longitudinal axis of the tool collar 211 and extend intermediate the plurality of cavities 302. The through holes 304 can extend between adjacent cavities 302. For example, in some embodiments, the plurality of through holes 304 can penetrate from an outer circumferential surface of the tool collar 211 and extend in a direction generally in an orthogonal plane to the length of the tool collar 211. Further, in accordance with the illustrated embodiments, each of the first, second, and third pad retention housings 221A, 221B, and 221C has a respective through hole 320A, 320B, and 320C for receiving a first end of a respective fastener 318 therein. Additionally, each of the first second and third pad retention housings 221A, 221B, and 221C include an engagement hole 320A, 320B, and 320C for receiving a second end of the fastener 318 therein. Thus, each of the fasteners 318 can extend between adjacent pad retention housings 221A, 221B, and 221C to interconnect the pad pushers 223 around the tool collar. For example, illustratively, a first fastener 318A extends through the through hole 320A of the first pad retention housing 211A, through the tool collar through hole 304A, and into the engagement hole 322B of the adjacent second pad retention housing 221B. Similarly, a second fastener 318B extends through the through hole 320B of the second pad retention housing 211B, through the tool collar through hole 304B, and into the engagement hole 322C of the adjacent third pad retention housing 221C. This pattern can be repeated for two, three, four, or more pad retention housings. In the illustrated embodiments, the pad retention housings 221A, 221B, and 221C may be arranged in a triangular, cross-sectional configuration around the tool collar 211. Thus, a third fastener 318C can extend through the through hole 320C of the third pad retention housing 211C, through the tool collar through hole 304C, and into the engagement hole 322A of the adjacent first pad retention housing 221A. However, the various embodiments described herein are not limited to the aforementioned configuration. For example, in some embodiments, the pad retention housings may be coupled to each other in a square or rectangular configuration. In these embodiments, four pad retention housings may be provided along with four fasteners.

In some embodiments, each of the pad retention housings 221A, 221B, and 221C can include a two part-housing having opposing sections of each housing being disposed on either side of a space or receptacle in which the respective pad pusher 223 can move. Further, each section of the housing can be fastened to the tool collar 211 via two apertures and a fastener. Thus, a total of six fasteners (in the triangular coupling configuration), and a total of eight fasteners (in the square/rectangular coupling configuration) maybe provided for each steering head 218 of the present disclosure.

In accordance with some embodiments, as illustrated, the fasteners 318 (318A, 318B, and 318C) may each be a bolt having a head 340 (340A, 340B, and 340C) at a first end portion. The head 340 can be configured to enable application of a torque thereto in order to tightly secure the fasteners 318 within the housings 221 (221A, 221B, and 221C) during assembly. Illustratively, each bolt head 340 is disposed, for example, in a first housing, e.g. pad retention housing 221A, and a second end portion of the bolt is positioned in the engagement hole 322B of the adjacent housing 221B so as to securely mount each of the respective pad pushers 223 to the collar 211.

Figure 5:
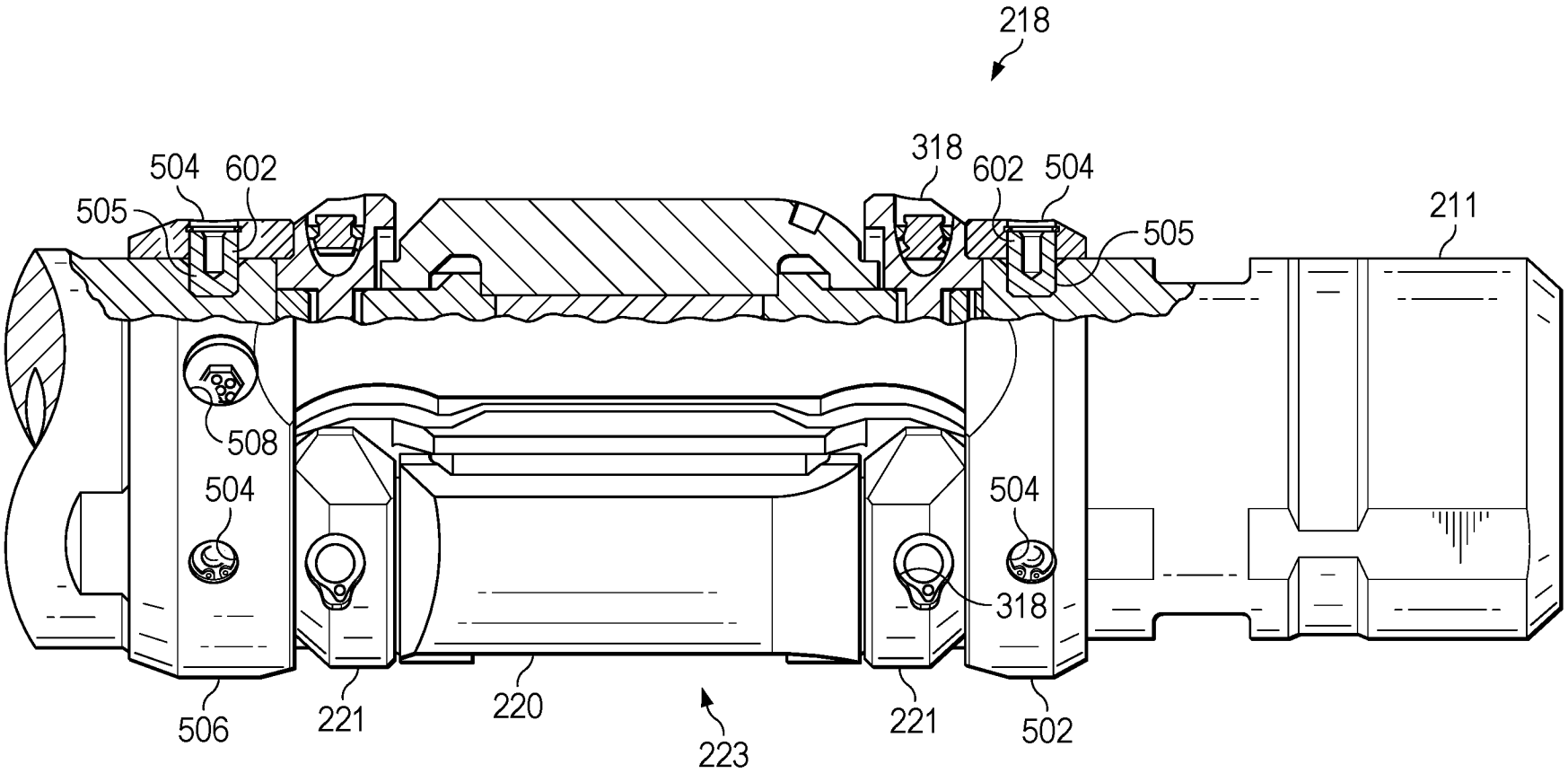
FIG. 5 illustrates a partial perspective side view of the example downhole tool including secondary pad retention mechanisms, according to some embodiments of the present disclosure.
Figure 6:
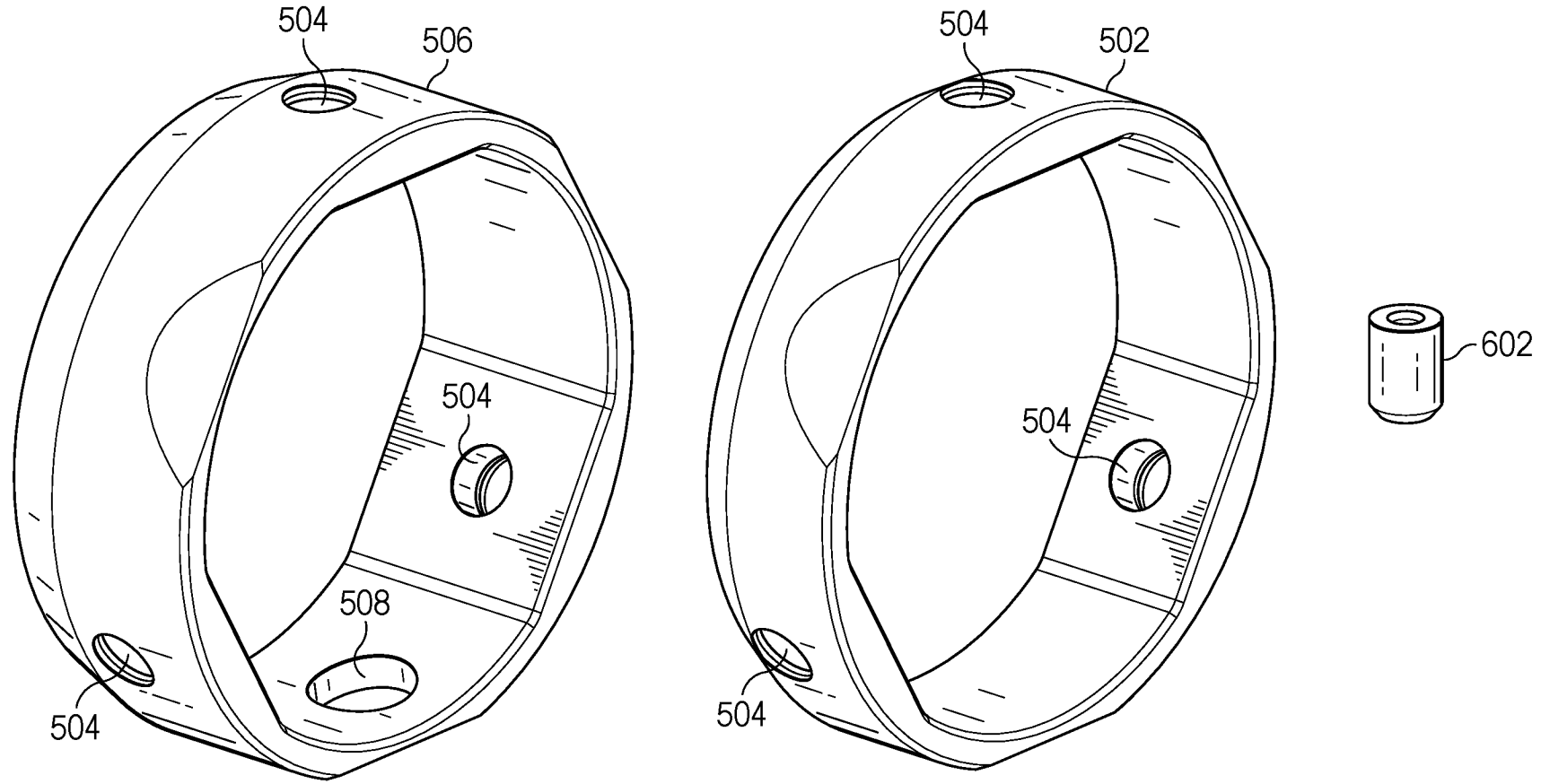
FIG. 6 illustrates perspective views of the secondary pad retention mechanisms of FIG. 5, according to some embodiments of the present disclosure.

Referring now to FIG. 5, a side and partially sectional view of the steering head 218 having pad rings 502 and 506 attached to the collar 211 at the downhole end and uphole end thereof, respectively, is shown. As illustrated in FIGS. 5 and 6 (which depicts a perspective view of the pad rings 502 and 506), each of the pad rings 502 and 506 are formed as a continuous ring body and are of a diameter to be slidable to fit over the collar 211 and couple with respective pad retention housings 221.

The body of each pad ring 502 and 506 may include openings 504 (and an opening 508 on the pad ring 506) positioned therealong, in which each opening 504 (and/or 508) is alignable with an engagement hole 505 in the collar 211. In some embodiments, the pad rings 502 and 506 may be secured to the collar 211 by fastening a shear pin 602 through each opening 504 (and/or 508) from the exterior of the body of the pad ring 502 (and/or 506) and into the respective engagement hole 505. In other embodiments, the pad rings 502 and 506 may include an internal threading to enable the pad rings 502 to rotatably engage with an external threading formed on the collar 211. In coupling with the respective pad retention housing 221, the pad ring 502 (and/or 506) provides an additional means to secure the respective pad retention housing 221 and preserve the structure of the steering assembly even if the fasteners 318 come loose or otherwise break. For example, when attached using shear pins 602, the pad ring 502 (and/or 506) will remain in place unless all shear pins 602 are broken (or otherwise are removed). Further, the shear pins 602, during operation of the downhole tool, are subject to less stress compared to the fasteners 318 of the pad retention housings 221, and thus are less likely to break down or come apart.

Each of the pad rings 502 and 506 may be formed of a material capable of withstanding downhole environmental conditions, such as stainless steel. In other embodiments, the pad rings 502 and 506 may be formed of a magnetic material. Although the illustrative embodiment depicts pad rings 502 and 506 attached at the downhole end and uphole end of the collar 211 respectively, one of skill in the art will recognize that some embodiments may attach the pad ring 502 (or 506) at only one of the downhole end or the uphole end.

Although the illustrative embodiment depicts pad rings 502 and 506 as secondary retention mechanisms used to couple with and further secure retention pad housings 221, other secondary retention mechanisms may be used in place of a continuous ring-shaped body. For example, the secondary retention mechanism may be embodied as a block-shaped body with the interior thereof fitting around the tool collar 211.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1 includes a rotary steerable system, comprising a tool collar having a plurality of cavities and a plurality of through holes extending therethrough to interconnect the plurality of cavities, the tool collar having a downhole end and an uphole end; a plurality of pad pushers each positionable within the plurality of cavities to be coupled to the tool collar, each pad pusher being coupled to a respective pad retention housing on the uphole end and the downhole end; and a secondary retention mechanism slidably attached to the tool collar and coupled with a respective pad retention housing.

Clause 2 includes the subject matter of Clause 1, and further including a plurality of shear pins securing the secondary retention mechanism to the tool collar.

Clause 3 includes the subject matter of any of Clauses 1 and 2, and wherein the secondary retention mechanism includes an internal threading, wherein the tool collar includes an external threading, and wherein the internal threading of the secondary retention mechanism rotationally engages with the external threading of the tool collar.

Clause 4 includes the subject matter of any of Clauses 1-3, and wherein the secondary retention mechanism is slidably attached to the tool collar and coupled with a respective pad retention housing at the uphole end of the tool collar.

Clause 5 includes the subject matter of any of Clauses 1-4, and wherein the secondary retention mechanism is slidably attached to the tool collar and coupled with a respective pad retention housing at the downhole end of the tool collar.

Clause 6 includes the subject matter of any of Clauses 1-5, and further including a second secondary retention mechanism slidably attached to the tool collar and coupled with a respective pad retention housing from the uphole end.

Clause 7 includes the subject matter of any of Clauses 1-6, and wherein the secondary retention mechanism is formed of a stainless steel material.

Clause 8 includes the subject matter of any of Clauses 1-7, and wherein the secondary retention mechanism is formed of a magnetic material.

Clause 9 includes the subject matter of any of Clauses 1-8, and wherein the secondary retention mechanism is a formed of a continuous ring body.

Clause 10 includes the subject matter of any of Clauses 1-9, and wherein the secondary retention mechanism is formed of a block-shaped body.

Clause 11 includes the subject matter of any of Clauses 1-10, and further including a plurality of fasteners, each extending between adjacent pad retention housings to interconnect the plurality of pad pushers around the tool collar, each fastener extending from a respective pad retention housing through hole.

Clause 12 includes the subject matter of any of Clauses 1-11, and wherein the rotary steerable system is for steering a drill string, wherein each pad pusher is movable between retracted and extended positions relative to the tool collar for steering the drill string, wherein the pad retention housing has an engagement hole extending partially therethrough and a through hole spaced apart from the engagement hole, the engagement hole and the through hole being alignable with corresponding through holes in the tool collar.

Clause 13 includes the subject matter of any of Clauses 1-12, and wherein the secondary retention mechanism has one or more openings alignable with corresponding engagement holes in the tool collar.

Clause 14 includes a method of assembling a rotary steerable system for steering a drill string, the method comprising providing a tool collar having a plurality of cavities and a plurality of through holes extending therethrough to interconnect the plurality of cavities; mounting a pad pusher within each of the cavities of the tool collar, each pad pusher being coupled to a pad retention housing, wherein the mounting includes aligning each of (1) an engagement hole extending partially through each pad retention housing, and (2) a through hole spaced apart from the engagement hole in each pad retention housing with corresponding through holes in the tool collar; and slidably attaching a secondary retention mechanism to the tool collar to couple the secondary retention mechanism and a respective pad retention housing.

Clause 15 includes the subject matter of Clause 14, and further including securing the secondary retention mechanism to the tool collar using a plurality of shear pins.

Clause 16 includes the subject matter of any of Clauses 14 and 15, and wherein the secondary retention mechanism includes an internal threading, wherein the tool collar includes an external threading, and further comprising rotationally engaging the internal threading of the secondary retention mechanism with the external threading of the tool collar.

Clause 17 includes the subject matter of any of Clauses 14-16, and wherein the secondary retention mechanism is slidably attached to the tool collar and coupled with a respective pad retention housing at the uphole end of the tool collar.

Clause 18 includes the subject matter of any of Clauses 14-17, and wherein the secondary retention mechanism is slidably attached to the tool collar and coupled with a respective pad retention housing at the downhole end of the tool collar.

Clause 19 includes the subject matter of any of Clauses 14-18, and further including slidably attaching a second secondary retention mechanism to the tool collar to couple the second secondary retention mechanism to the tool collar.

Clause 20 includes the subject matter of any of Clauses 14-19, and wherein the secondary retention mechanism is a formed of a continuous ring body.

As used herein, the singular forms "a," "an," and "the" are intended to include the plural forms as well, unless the context clearly indicates otherwise. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A rotary steerable system, comprising:

a tool collar having a plurality of cavities and a plurality of through holes extending therethrough to interconnect the plurality of cavities, the tool collar having a downhole end and an uphole end;

a plurality of pad pushers each positionable within the plurality of cavities to be indirectly coupled to the tool collar using fasteners and some of the plurality of through holes, and a respective primary pad retention housing, each pad pusher to be coupled to the respective pad retention housing on the uphole end and the downhole end; and a secondary retention mechanism to be slidably attached to the tool collar and coupled with the respective pad retention housing.

2. The rotary steerable system of claim 1, further comprising a plurality of shear pins securing the secondary retention mechanism to the tool collar.

3. The rotary steerable system of claim 1, wherein the secondary retention mechanism includes an internal threading, wherein the tool collar includes an external threading, and wherein the internal threading of the secondary retention mechanism rotationally engages with the external threading of the tool collar.

4. The rotary steerable system of claim 1, wherein the secondary retention mechanism is slidably attached to the tool collar and coupled with a respective pad retention housing at the uphole end of the tool collar.

5. The rotary steerable system of claim 1, wherein the secondary retention mechanism is slidably attached to the tool collar and coupled with a respective pad retention housing at the downhole end of the tool collar.

6. The rotary steerable system of claim 5, further comprising a second secondary retention mechanism slidably attached to the tool collar and coupled with a respective pad retention housing from the uphole end.

7. The rotary steerable system of claim 1, wherein the secondary retention mechanism is formed of a stainless steel material.

8. The rotary steerable system of claim 1, wherein the secondary retention mechanism is formed of a magnetic material.

9. The rotary steerable system of claim 1, wherein the secondary retention mechanism is a formed of a continuous ring body.

10. The rotary steerable system of claim 1, wherein the secondary retention mechanism is formed of a block-shaped body.

11. The rotary steerable system of claim 1, wherein the fasteners are to extend between adjacent pad retention housings to interconnect the plurality of pad pushers around the tool collar.

12. The rotary steerable system of claim 1, wherein the rotary steerable system is for steering a drill string, wherein each pad pusher is movable between retracted and extended positions relative to the tool collar for steering the drill string, wherein the pad retention housing has an engagement hole extending partially therethrough and a through hole spaced apart from the engagement hole, the engagement hole and the through hole being alignable with corresponding through holes in the tool collar.

13. The rotary steerable system of claim 1, wherein the secondary retention mechanism has one or more openings alignable with corresponding engagement holes in the tool collar.

14. A method of assembling a rotary steerable system for steering a drill string, the method comprising:

providing a tool collar having a plurality of cavities and a plurality of through holes extending therethrough to interconnect the plurality of cavities;

mounting a pad pusher within each of the cavities of the tool collar, each pad pusher to be coupled to a respective primary pad retention housing, wherein the mounting includes aligning each of (1) an engagement hole extending partially through each pad retention housing, and (2) a through hole spaced apart from the engagement hole in each pad retention housing with corresponding through holes in the tool collar, each pad pusher being indirectly coupled to the tool collar using fasteners and some of the plurality of through holes; and slidably attaching a secondary retention mechanism to the tool collar to couple the secondary retention mechanism and a respective pad retention housing.

15. The method of claim 14, further comprising securing the secondary retention mechanism to the tool collar using a plurality of shear pins.

16. The method of claim 14, wherein the secondary retention mechanism includes an internal threading, wherein the tool collar includes an external threading, and further comprising rotationally engaging the internal threading of the secondary retention mechanism with the external threading of the tool collar.

17. The method of claim 14, wherein the secondary retention mechanism is slidably attached to the tool collar and coupled with a respective pad retention housing at the uphole end of the tool collar.

18. The method of claim 14, wherein the secondary retention mechanism is slidably attached to the tool collar and coupled with a respective pad retention housing at the downhole end of the tool collar.

19. The method of claim 18, further comprising slidably attaching a second secondary retention mechanism to the tool collar to couple the second secondary retention mechanism to the tool collar.

20. The method of claim 14, wherein the secondary retention mechanism is a formed of a continuous ring body.

* * * * *